US008038034B2

(12) United States Patent
Pelfrey

(10) Patent No.: US 8,038,034 B2
(45) Date of Patent: Oct. 18, 2011

(54) FLUID DISPENSER FOR PERSONAL USE

(75) Inventor: Keith A. Pelfrey, Wadsworth, OH (US)

(73) Assignee: GOJO Industries, Inc., Akron, OH (US)

( * ) Notice: Subject to any disclaimer, the term of this patent is extended or adjusted under 35 U.S.C. 154(b) by 456 days.

(21) Appl. No.: 12/287,004

(22) Filed: Oct. 3, 2008

(65) Prior Publication Data

US 2010/0084432 A1 Apr. 8, 2010

(51) Int. Cl.
*B67B 1/00* (2006.01)

(52) U.S. Cl. ..... 222/153.13; 222/182; 222/207; 222/214

(58) Field of Classification Search ..... 222/153.01, 222/153.13–153.14, 173, 182, 394, 628, 222/207, 214
See application file for complete search history.

(56) References Cited

U.S. PATENT DOCUMENTS

| | | | | |
|---|---|---|---|---|
| 4,921,136 | A * | 5/1990 | Roggenburg, Jr. | 222/95 |
| 5,673,819 | A * | 10/1997 | Brunswig | 222/113 |
| 6,789,706 | B2 | 9/2004 | Abergel et al. | |
| 7,419,322 | B2 | 9/2008 | Laflamme et al. | |
| 2004/0188471 | A1 * | 9/2004 | Cellini et al. | 222/192 |
| 2006/0186140 | A1 | 8/2006 | Kanfer et al. | |
| 2007/0023453 | A1 | 2/2007 | Simkins | |

* cited by examiner

*Primary Examiner* — Kevin P Shaver
*Assistant Examiner* — Andrew Bainbridge
(74) *Attorney, Agent, or Firm* — Renner, Kenner, Greive, Bobak, Taylor & Weber

(57) ABSTRACT

Personal dispensers include a refill unit and a refill casing. The refill unit is a collapsible container that is associated with pump mechanisms for dispensing fluid from within the collapsible container. The refill casing retains and protects the refill unit, and includes a pump lock that is manipulated to selectively cover a pump opening in the refill casing. When the pump lock covers the pump opening, the pump mechanisms cannot be manipulated, and when the pump lock does not cover the pump opening, the pump mechanisms can be manipulated to dispense product.

7 Claims, 6 Drawing Sheets

FLUID DISPENSER FOR PERSONAL USE

TECHNICAL FIELD

The present invention generally relates to fluid dispensers, and, more particularly, relates to personal, portable fluid dispensers. In specific preferred embodiments, this invention relates to portable, personal fluid dispensers that provide a protective casing for a refill unit and include elements for preventing accidental dispensing of product from the refill unit.

BACKGROUND OF THE INVENTION

Portable containers for dispensing cleaning or sanitizing solutions are generally known, and most commonly are semi-rigid containers that can be selectively opened or closed so that the solution retained in the container may be dispensed. These containers are herein termed "semi-rigid" because, although being formed of rigid materials, they give to pressure such that their interior volume can be temporarily decreased in order to dispense some of the solution retained therein. These types of portable personal dispensers are very popular for dispensing hand sanitizer, hand cleaner, and hand lotion. The amount of fluid they dispense is typically dependent upon the degree to which they are squeezed, and is thus variable between uses.

Hand sanitizers, hand cleaners, and hand lotions are also dispensed through the use of positive displacement pumps and wall-mounted dispensers, as generally known. These devices typically include a reciprocating piston member or pivoting lever member that causes pump mechanisms to dispense product upon being reciprocated or pivoted. These dispensers provide the beneficial feature of providing a user with a unit dose of the hand treatment solution upon activation of their dispensing mechanics, though they are typically not employed as portable personal dispensers because the piston or lever member can be unintentionally actuated to cause an accidental dispensing of product. For instance, though a piston-type pump dispenser might be of a size suitable for carrying in a large pocket or purse, the piston can be reciprocated by contact with the body of the person carrying the dispenser or by contact with items in the purse.

Some less common personal dispensers that have to date not achieved widespread use are both readily portable and provide for dispensing a unit dose of product. Exemplary embodiments of these portable personal dispensers can be found in U.S. Pat. No. 6,789,706 and U.S. Published Patent Application Nos. 2006/0186140 and 2005/0199651. These types of dispensers are characterized by the employment of a dome pump mechanism positioned between an outlet of the dispenser and fluid held within a portable container. Because these types of dispensers are of particular interest as refill units, they are first generally disclosed, as background, and the present invention is then disclosed in the description of the invention.

The "refill units" of this invention are basically personal dispensers, and can be characterized by a minimal number of elements. These elements are numbered and identified in exemplary embodiments shown in FIGS. 1, 2 and 3, and discussed here, with elements of FIG. 1 being distinguished by employing the letter A, elements of FIG. 2 being distinguished by employing the letter B, and elements of FIG. 3 being distinguished by employing the letter C after the numeral identifying an element. Thus, these prior art personal dispensers 10A, 10B and 10C include a collapsible container 12A, 12B, 12C that defines an interior volume that holds fluid F and is sealed at its perimeter so as to collapse as fluid F is dispensed therefrom. The collapsible container 12A, 12B, 12C is typically formed of film material, which, notably, might be punctured by a sharp object. A pump mechanism 14A, 14B, 14C communicates with the fluid F in the container 12A, 12B, 12C. The pump mechanism 14A, 14B, 14C includes a collapsible dosing chamber 16A, 16B, 16C that normally rests in an uncompressed state, providing an expanded volume, as shown. A fluid outlet path 18A, 18B, 18C fluidly communicates with interior volume of the pump mechanism 14A, 14B, 14C and provides an exit 20A, 20B, 20C communicating externally of the interior volume of the container 12A, 12B, 12C. In the embodiments of FIGS. 1 and 2, the fluid outlet paths 18A and 18B extend through rigid nozzle portions 19A, 19B, but in the embodiment of FIG. 3, the outlet path 18C extends through a non-rigid outlet extension 19C. The outlet path 18C can be formed of two films secured together to create a path that is effectively sealed to fluid flow until fluid pressure causes the films to be forced apart to open the outlet path 18C and permit the dispensing of fluid.

Operating the pump mechanism 14A, 14B, 14C forces a portion of the fluid through the fluid outlet path 18A, 18B, 18C and out the exit 20A, 20B, 20C thereof. More particularly, the pump mechanism 14A, 14B, 14C includes inlet and outlet valves that function to regulate the flow of fluid F into and out of collapsible dosing chamber 16A, 16B, 16C, and these valves open and close upon operation of the pump mechanism 14A, 14B, 14C. The inlet and outlet valves can be seen in FIGS. 2 and 3, and the valves for FIG. 1 are shown in the pump mechanism 14A of FIG. 4. Additionally, in the refill unit 16C of FIG. 3, the extension 19C, being normally closed, acts as a valve, permitting dispensing of fluid when the pressure behind the exit 20C. Pressing on the collapsible dosing chamber 16A, 16B, 16C moves it to a collapsed state, having a compressed volume, and fluid F held within the collapsible dosing chamber 16A, 16B, 16C is thus forced out through the fluid outlet path 18A, 18B, 18C and exit 20A, 20B, 20C. An outlet valve 22A, 22B, 22C of pump mechanism 14A, 14B, 14C may be provided to permit flow of the fluid F from within collapsible dosing chamber 16A, 16B, 16C toward and through exit 20A, 20B, 20C, but not in the opposite direction. Similarly an inlet valve 24A, 24B, 24C in pump mechanism 14A, 14B, 14C permits flow of the fluid F from the interior of collapsible container 12A, 12B, 12C into the collapsible dosing chamber 16A, 16B, 16C, but not in the opposite direction. As mentioned, the outlet valve 22C can be provided as two films joined together to create a path that is effectively sealed to fluid flow until fluid pressure causes the films to be forced apart to open the outlet path 18C and permit the dispensing of fluid. In this way, pressing on collapsible dosing chamber 16A, 16B, 16C to assume a collapsed state forces fluid F out of exit 20A, 20B, 20C, while releasing the collapsible dosing chamber 16A, 16B, 16C from the collapsed state draws fluid into the collapsible dosing chamber 16A, 16B, 16C as it expands to an expanded state. Normally, the collapsible dosing chamber 16A, 16B, 16C is formed of a resilient material that naturally returns to its expanded state, but a spring or other biasing element might be employed in the interior of the collapsible dosing chamber to urge it to the expanded state.

The foregoing prior art personal dispensers are offered as examples of refill units that can be employed in accordance with the present invention, but it should be appreciated that other personal dispensers having different structures could be employed as refill units.

Though these types of personal dispensers offer desired functions, they present some undesired problems in that they can be unintentionally actuated to cause an undesired dispensing of product. They also typically have flexible, thin film walls that might be compromised by any sharp object carried in close proximity to the dispenser. Thus a need exists in the art for a portable personal dispenser assembly that can be actuated to provide a unit dose of fluid and can also be manipulated to prevent unwanted dispensing. This invention provides such a dispenser through the provision of a casing that is to carry a portable dispenser of the type generally disclosed above.

SUMMARY OF THE INVENTION

This invention provides a portable personal dispenser assembly that includes a refill unit and a refill unit casing. The refill unit includes a container having an interior volume holding a fluid, a pump mechanism communicating with the fluid in the container, and a dispensing nozzle fluidly communicating with the pump mechanism and communicating externally of the interior volume of the container. Operating the pump mechanism forces a portion of the fluid through the dispensing nozzle and out at an exit of the dispensing nozzle. The refill unit casing includes a housing defining an interior retaining the refill unit. An exit opening in the housing communicates with the dispensing nozzle such that fluid dispensed out the exit of the dispensing nozzle also exists the housing through the exit opening. A pump opening is provided in the housing, and the pump mechanism is aligned with the pump opening when the refill unit is retained in the container, such that the pump mechanism is operated by manipulating the collapsible dosing chamber at the pump opening. A pump lock is associated with the refill unit casing and is manipulated to selectively cover the pump opening, wherein, when the pump lock covers the pump opening, the pump mechanism cannot be manipulated through the pump opening.

PREFERRED EMBODIMENT FOR CARRYING OUT THE INVENTION

Figure 1:
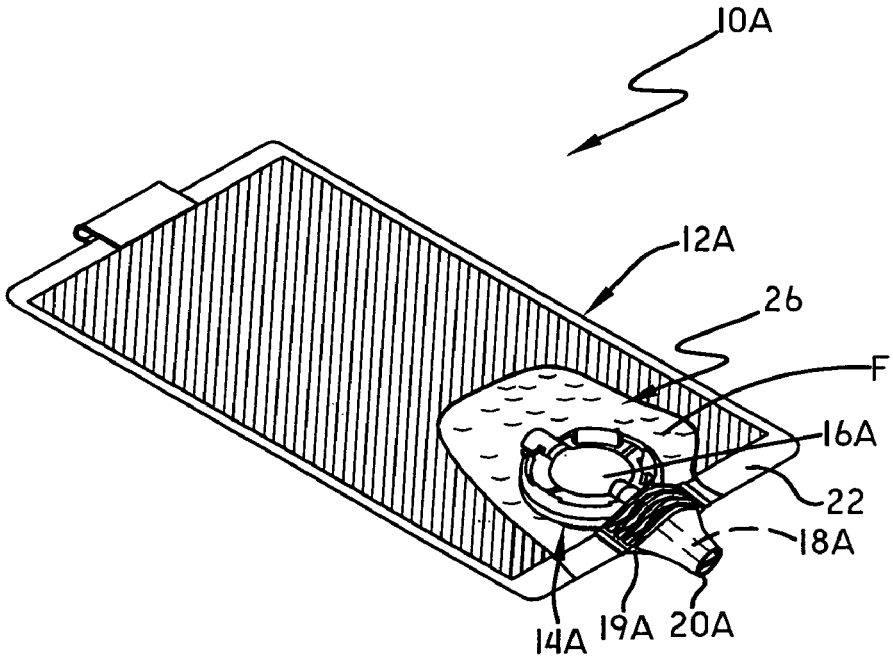
FIG. 1 is a perspective view of a prior art dispenser that may serve as a refill unit in accordance with this invention, with a portion of the refill unit removed to show portions of a pump mechanism.
Figure 2:
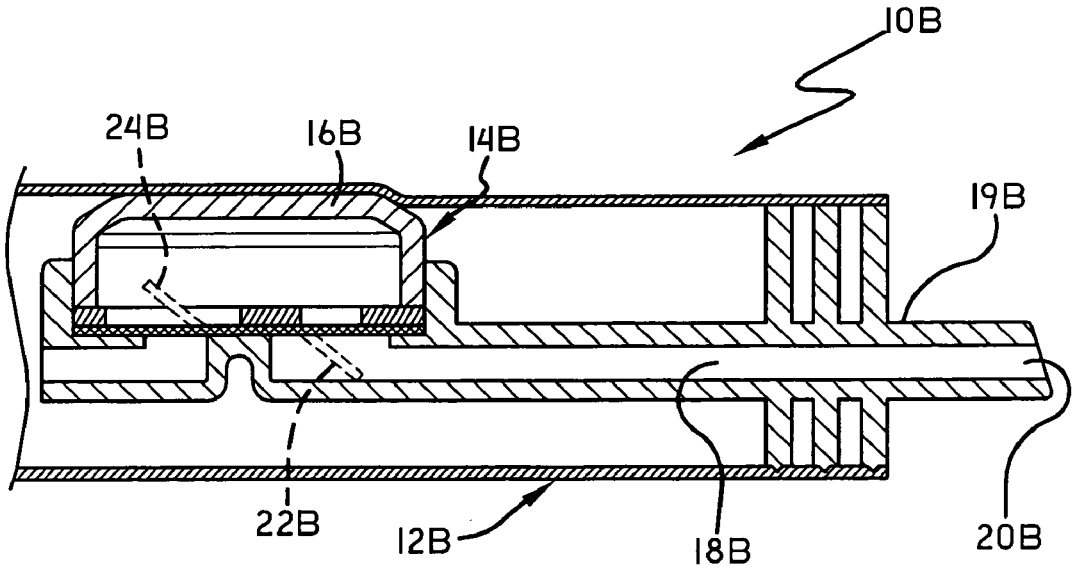
FIG. 2 is a cross section of another embodiment of a prior art dispenser useful as a refill unit.
Figure 3:
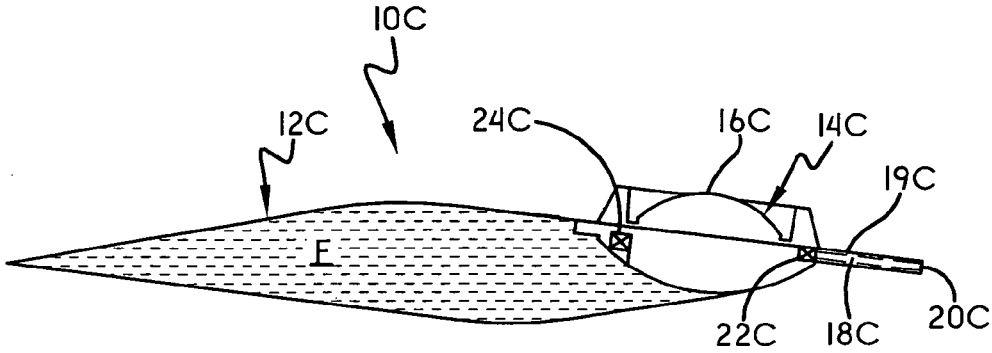
FIG. 3 is a cross section of yet another embodiment of a prior art dispenser useful as a refill unit.
Figure 4:
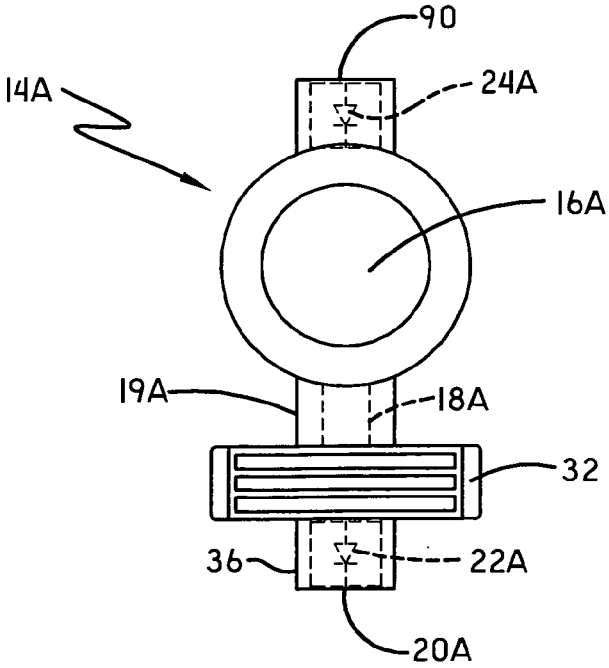
FIG. 4 is a top plan view of a general prior art embodiment for a pump mechanism useful for this invention and, more particularly, used in the dispenser of FIG. 1.

It should be appreciated that the dispensers shown in FIGS. 1 through 3 and the pump structure of FIG. 4 are merely exemplary embodiments of the type of device that might be employed as a refill unit in accordance with the combination refill unit and refill unit casing that forms the personal portable dispenser of this invention. The refill units may take specific forms not shown here. Refill units for this invention include a container having a pump mechanism with a collapsible dosing chamber that is manipulated to dispense fluid from within the container through an outlet path, as generally covered in the background above.

Figure 5:
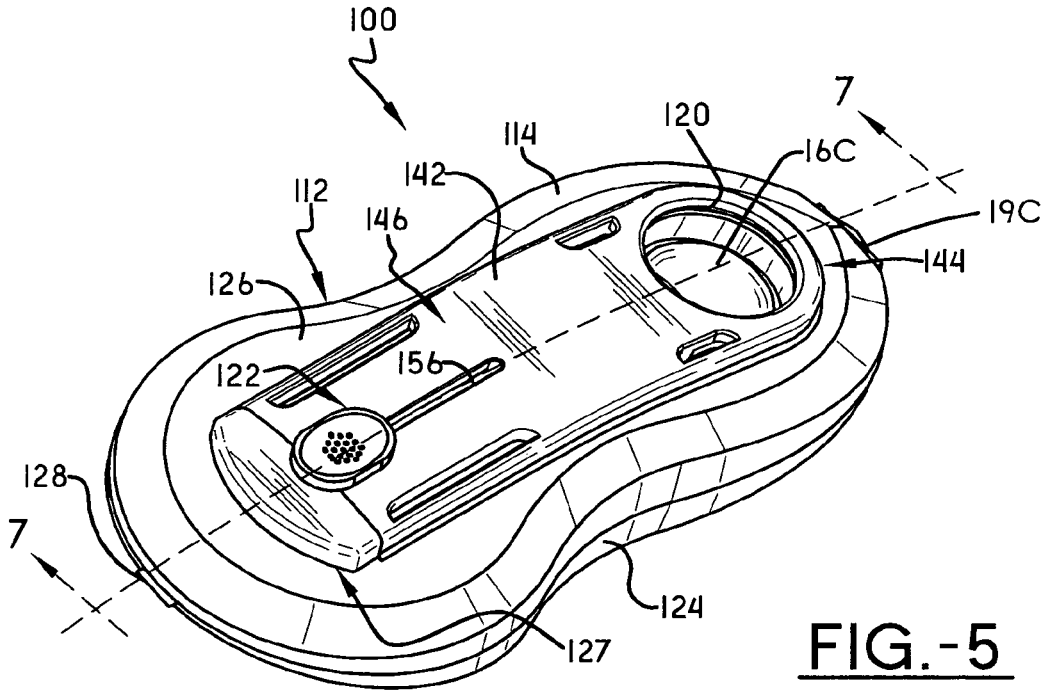
FIG. 5 is a perspective view of an embodiment of a personal portable dispenser in accordance with this invention, shown with the pump lock opened to permit access to the pump mechanism of the refill unit.
Figure 6:
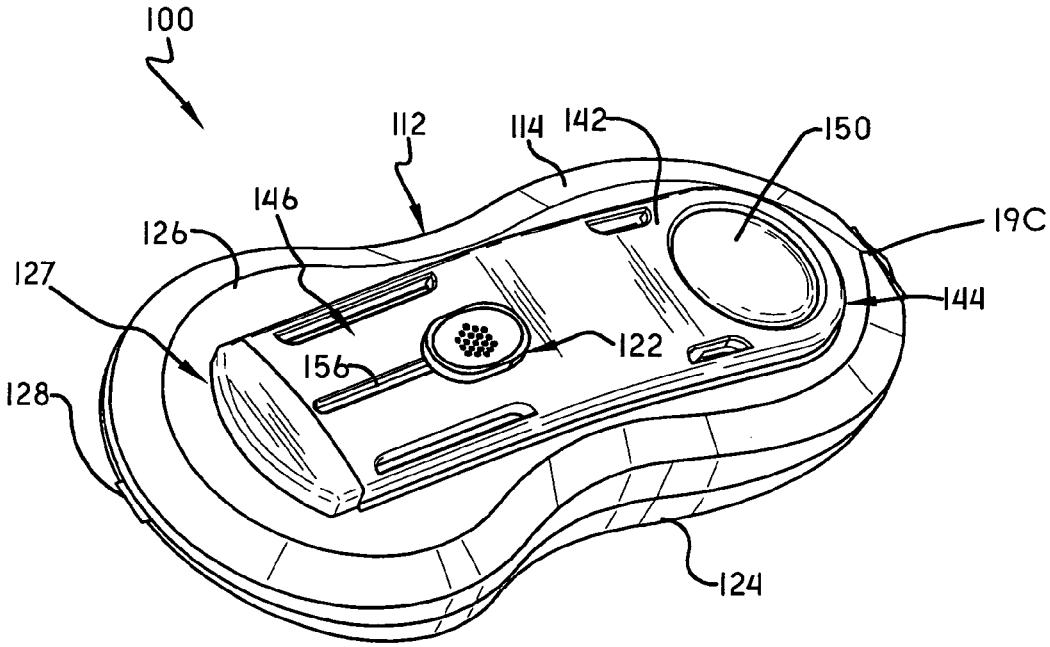
FIG. 6 is a perspective view of an embodiment of a personal portable dispenser in accordance with this invention, shown with the pump lock closed to prohibit access to the pump mechanism of the refill unit.
Figure 7:
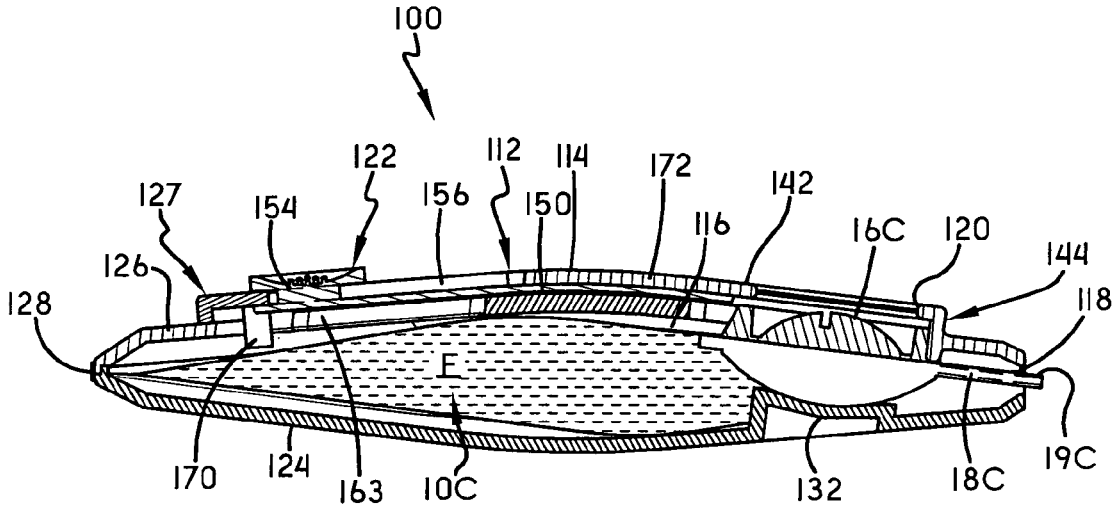
FIG. 7 is a cross sectional view taken along the line 7-7 in FIG. 6.

Referring now to FIGS. 5-7, an embodiment of a personal portable dispenser is shown and designated by the numeral 100. This embodiment employs a dispenser like that shown in FIG. 3 as the refill unit. The personal portable dispenser 100 includes a refill casing 112 and a refill unit 10C.

Refill casing 112 includes a housing 114, a pump lock 122 and a lock cap 127. The housing 114 defines an interior 116 that is preferably sized and shaped to intimately receive and retain a refill unit 10C. The outlet path 18C of the refill unit 10C is different from the outlet paths of the other exemplary refill units 10A and 10B disclosed above because the outlet path of the refill unit 10C does not extend through a rigid nozzle portion, but rather, through an outlet extension 19C extending slightly beyond the remainder of the sealed perimeter of the collapsible container 12C. The outlet extension 19C extends through an exit opening 118 in the housing 114 such that fluid dispensed through the exit 20C of the outlet path 18C also exits the housing 114 and is not likely to leak into the interior of the housing 114. A pump opening 120 is provided in the housing 114 to align with the collapsible dosing chamber 16C when the refill unit 10C is received and retained by the housing 114. In this way, the collapsible dosing chamber 16C can be operated by being manipulated through the pump opening 120. For those refill units with rigid nozzle portions, the rigid nozzle portion would extend through an exit opening in a housing design for such refill units.

A pump lock 122 is received by the housing 114 and lock cap 127 to slide relative to the housing 114, and is manipulated to selectively cover the pump opening 120. When the pump lock 122 covers the pump opening 120 (see FIG. 6), the collapsible dosing chamber 16C of the refill unit 10C cannot be accessed to dispense fluid F. But when the pump lock is moved so as not to cover the pump opening 120 (see FIG. 5), the collapsible dosing chamber 16C can be operated to dispense fluid F. Thus, through the combination of a refill unit 10C and a refill casing 112, a personal dispenser 100 is provided wherein a refill unit 10C may be carried by an individual without concern for accidental actuation of the pump or puncturing of the collapsible container, because the refill unit 10C is protected by the refill casing 112.

Figure 8:
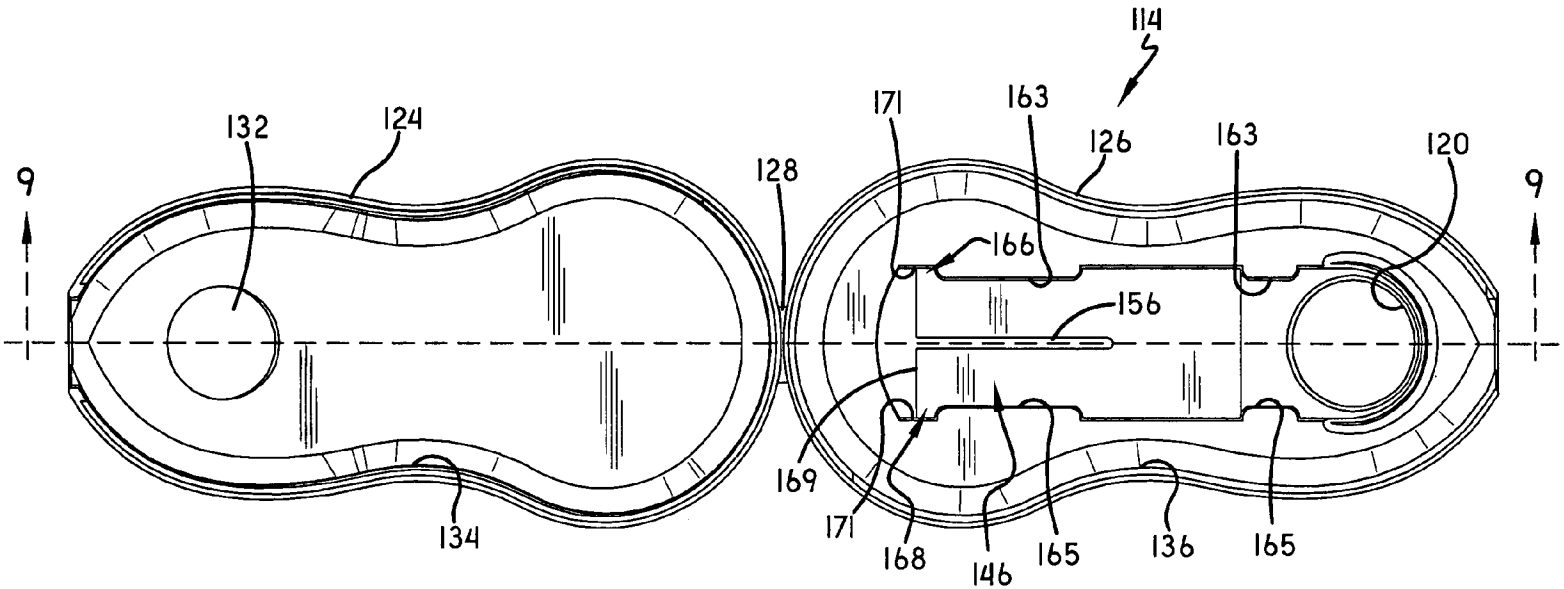
FIG. 8 is a top plan view of the refill casing of the personal portable dispenser of this invention, shown opened to receive a refill unit.

Although other housing structures can be practiced to allow for easy installation and removal of a refill unit 10C, with such structures being well within the general skill in the art to select and implement, the embodiment shown here, as seen in FIG. 8, provides a clamshell type housing 114 having a first housing member 124 and a second housing member 126 joined with one or more living hinges 128. The housing shown in FIG. 8 can be molded as one integral piece, including the living hinges 128. The pump lock 122 can also be molded as one piece, as can the lock cap 127, both which will be described more fully below. Thus, this embodiment could be a three piece assembly, as will be described more fully below.

The interior surface 130 of the first housing member 124 preferably A includes a pump chamber contour 132 to help urge the collapsible dosing chamber 16C up toward pump opening 120 and align it therewith. Pump chamber contour 132 also helps maintain the proper positioning of the collapsible dosing chamber 16C though the collapsible container 12C looses volume and thus collapses as doses of fluid F are dispensed. The second housing member 126 pivots on the living hinge 128 to enclose a refill unit 10C placed in housing 114. The pump opening 120 of second housing member 126 aligns with the collapsible dosing chamber 16C to permit access to the collapsible dosing chamber 16C when the second housing member 126 is closed onto the first housing member 124 to enclose a refill unit 16C. The first and second housing members 124, 126 can be made to securely yet releasably join to enclose the refill unit 16C by having rims 134, 135 that mate through a common snap fit. It will be appreciated that the mating of the first and second housing members 124, 126 can be achieved in a multitude of ways, and this invention is not limited by any particular structure employed.

The pump opening 120 is provided in a top wall 142 of a pump cage 144 provided here as a raised portion of second housing member 126. The collapsible dosing chamber 16C extends up into pump cage 144, and is aligned with pump opening 120 so that it can be accessed to dispense fluid F. The pump lock 122 is received in a lock support 146, also provided here as a raised position of the second housing member 126 extending smoothly from the pump cage 144, at juncture 172. The pump lock 122 is manipulated to selectively cover the pump opening 120. The pump lock 122 covers the pump opening 120 (FIG. 6), the collapsible dosing chamber 16C of the refill unit 10C cannot be accessed to dispense fluid F, and the refill unit 10C is protected by the housing 114.

Figure 9:
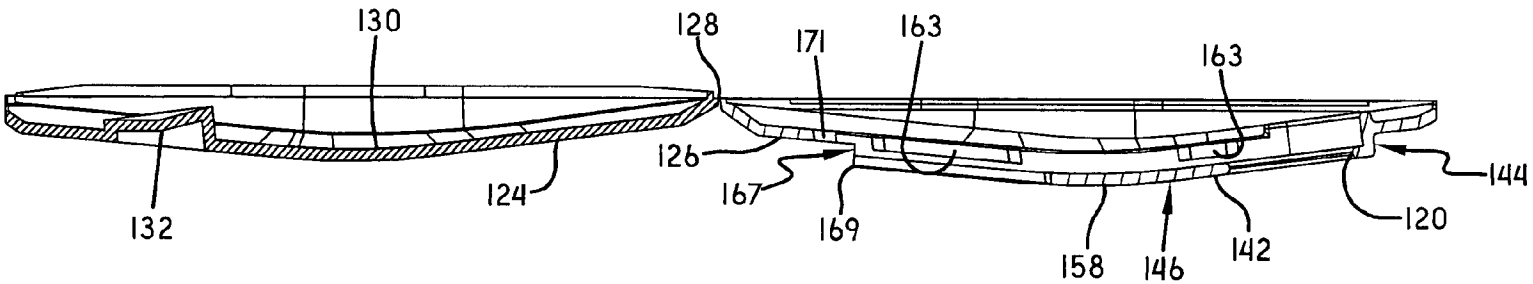
FIG. 9 is a cross-sectional view taken along the line 9-9 in FIG. 8.
Figure 10:
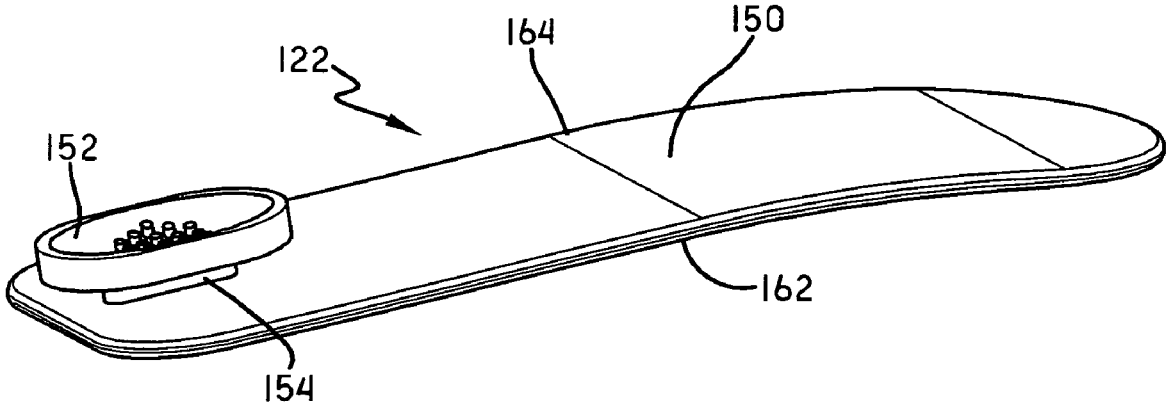
FIG. 10 is a perspective view of a pump lock of the personal portable dispenser of this invention.

With reference to FIGS. 7 and 10, it can be seen that the pump lock 122 includes a plate member 150 from which extends a slide tab 152, raised off of the plate member 150 by a stem member 154. The lock support 146 includes a stem slot 156 through which the stem member 154 extends, such that the plate member 150 is held below the top wall 158 of the lock support 146, and the slide tab 152 rests above A the top wall 158 to be accessed at the exterior of the housing 114. Beneath top wall 158 of lock support 146, the opposed side edges 162, 164 of plate member 150 preferably extend into opposed slide channels 166, 168, defined by a plurality of tabs 163, 165 which extend along lock support 146 (FIGS. 8 and 9). These slide channels 166, 168 improve the structural integrity of the pump lock 122 and its interaction with the housing 114.

In the particular embodiment shown here, wherein the first and second housing members 124, 126 are a single molded piece as are the pump lock 122 and lock cap 127, the pump lock 122 is assembled into the refill casing 112 before securing the lock cap 127 to the remainder of the refill casing 112. Lock cap 127 joins to housing 114 to retain the pump lock 122 in slide channels 166, 168. The lock cap 127 is secured to the second housing member 126 after the pump lock 122 is inserted into the lock support 146. As seen in FIG. 9, the lock support 146 defines a lock support opening 167 at its distal end 169, and the stem slot 156 is open at this distal end 169 such that the stem member 154 of the pump lock 122 can be inserted into the stem slot 156, with the plate member 150 held below the lock support 146 in slide channels 166, 168, and the slide tab held above lock support 146 for manipulation by a user's fingers or thumb. After the pump lock 122 is engaged with the lock support 146 in this manner, the lock cap 127 can be secured to the second housing member to complete the assembly of the refill casing 112.

Figure 11:
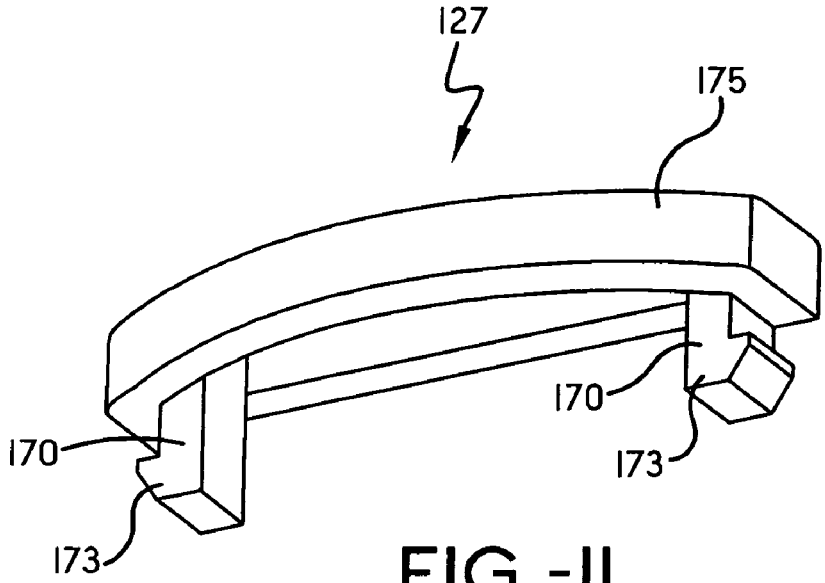
FIG. 11 is a perspective view of a lock cap of the personal portable dispenser of this invention.

As can be seen in FIG. 11, lock cap 127 includes tabs 170 that engage the side edges 171 in second housing member 126 proximate the distal end 169 of lock support 146. The lock cap 127 is secured through the well known snap-fit interaction of the beveled edges 173 of the tabs 170 with the edges 171. A cap portion 175 fits intimately to close off the lock support opening 167.

The pump lock 122 is moved by manipulating the slide tab 152 such that the plate member 150 either opens the pump opening 120 to permit actuation of the collapsible dosing chamber 16C or closes the pump opening 120 to prohibit such actuation. The plate member 150 of the pump lock 122 is rigid enough to prevent actuation of the collapsible dosing chamber 16C, when closed over pump opening 120, but is also flexible enough to bend at the juncture 172 of lock support 146 and pump cage 144, so that the plate member 150 can be urged over the pump opening 120 in the pump cage, which, as can be seen in FIG. 7, is slightly angled with respect to the lock support 146. This angling of the pump cage 144 will provide the housing with a shape that is comfortable in the user's hand. The plate member 150 bends at juncture 172 as it is urged to close pump opening 120 because the plate member 150 is somewhat resilient and is thus forced to bend as it contacts the underside of the top wall 142 of the pump cage 144.

Through the combination of a refill unit 10C and a refill casing 112, a personal dispenser 100 is provided wherein a refill unit 10C may be carried around without concern for accidental dispensing, due to the ability to close off access to the collapsible dosing chamber 16C of the refill unit 10C. The collapsible container 12C of the refill unit 10C is also protected by the housing 114. Again, it should be appreciated that the refill unit 10C is only an example of a type of refill unit that could be employed in accordance with this invention. The particular dispenser taught here provides adequate guidance for adapting the refill casing structures to other types of refill units.

Thus, in light of the foregoing, it should be evident that the process of the present invention, providing personal dispensers, substantially improves the art. While, in accordance with the patent statutes, only the preferred embodiments of the present invention have been described in detail hereinabove, the present invention is not to be limited thereto or thereby. Rather, the scope of the invention shall include all modifications and variations that fall within the scope of the attached claims.

What is claimed is:

1. A portable personal dispenser comprising:

(a) a personal dispenser refill unit including:

a collapsible container having an interior volume holding a fluid, a collapsible dosing chamber communicating with said fluid in said container, and an outlet path fluidly communicating with said collapsible dosing chamber and communicating externally of said interior volume of said container, wherein operating said collapsible dosing chamber dispenses a dose of said fluid through said outlet path and out at an exit of said outlet path, whereby said interior volume of said collapsible container decreases by the volume of said dose; and (b) a handheld refill unit casing comprising:

a housing defining an interior retaining said refill unit, an exit opening in said housing communicating with said outlet path such that fluid dispensed out said exit of said outlet path also exits said housing through said exit opening, a pump opening in said housing, a contour extending into said interior of said housing to urge said collapsible dosing chamber to be positioned in and aligned with said pump opening when said refill unit is retained in said container such that said collapsible dosing chamber is operated by being manipulated at said pump opening, whereby said contour maintains the positioning and alignment of said collapsible dosing chamber with said pump opening as said interior volume of said collapsible container decreases, and a pump lock having a lock position and an unlock position, wherein, when in said lock position, said collapsible dosing chamber cannot be manipulated through said pump opening, and, when in said unlock position, said collapsible dosing chamber can be manipulated through said pump opening to dispense said fluid in said container.

2. A portable personal dispenser as in claim 1, wherein said collapsible dosing chamber defines a dose volume and includes:

an inlet communicating between said internal volume of said collapsible container and said dose volume;

an outlet communicating between said dose volume and said outlet path;

an inlet valve in said inlet that permits said fluid to enter said dose volume upon expansion of said collapsible dosing chamber from a collapsed state; and an outlet valve in said outlet that permits dispensing of said fluid upon collapsing said collapsible dosing chamber from an expanded state.

3. The personal dispenser of claim 2, wherein said housing of said refill unit casing includes first and second housing members selectively joined to retain said collapsible container in said interior, and selectively disjoined to provide access to said interior for replacement of said refill unit.

4. The personal dispenser of claim 3, further comprising a pump cage extending from said first housing member and providing said pump opening, said contour urging said collapsible dosing chamber into said pump cage.

5. The personal dispenser of claim 4, further comprising a pump lock support adjacent said pump cage.

6. The personal dispenser of claim 5, wherein said pump lock includes a plate member and a slide tab extending from said plate member by a stem member, said pump lock support including a stem slot through which said stem member extends, said slide tab being selectively manipulated to cover said pump opening.

7. The personal dispenser of claim 4, wherein said contour is provided in said second housing member.

* * * * *